United States Patent [19]

Hicks

[11] Patent Number: 4,677,834

[45] Date of Patent: Jul. 7, 1987

[54] ELECTRO-MECHANICAL SECURITY LOCK

[76] Inventor: Cecil B. Hicks, 13200 Bombay St., Sylmar, Calif. 91342

[21] Appl. No.: 909,279

[22] Filed: Sep. 19, 1986

Related U.S. Application Data

[63] Continuation-in-part of Ser. No. 763,424, Aug. 7, 1985, abandoned.

[51] Int. Cl.[4] ..... E05B 47/00

[52] U.S. Cl. ..... 70/279; 70/386; 292/144; 292/150; 292/252

[58] Field of Search ..... 70/279, 386, 282, 277; 292/252, 169.13, 144, 147, 150, 204, 207

[56] References Cited

U.S. PATENT DOCUMENTS

| | | | |
|---|---|---|---|
| 1,817,939 | 8/1931 | Purnell | 292/164 |
| 2,449,353 | 9/1948 | Whitmore | 292/173 |
| 2,764,440 | 9/1956 | Marko | 292/173 |
| 3,081,617 | 3/1963 | McKay | 70/153 |
| 3,743,336 | 7/1973 | Andrews | 292/191 X |
| 3,751,088 | 8/1973 | Schlage et al. | 70/279 X |
| 3,753,316 | 8/1973 | Savarieau et al. | 292/144 X |
| 3,828,592 | 8/1974 | Horgan | 292/170 X |
| 4,099,752 | 7/1978 | Geringer | 70/279 X |
| 4,111,477 | 9/1978 | Rigali | 292/252 |
| 4,434,635 | 3/1984 | Borgato | 70/279 |
| 4,509,347 | 4/1985 | Young | 70/279 X |
| 4,512,597 | 4/1985 | Nabb et al. | 292/252 X |
| 4,557,121 | 12/1985 | Charlton | 70/279 |
| 4,593,543 | 6/1986 | Stefanek | 292/144 X |

FOREIGN PATENT DOCUMENTS

| | | | |
|---|---|---|---|
| 15884 | 1/1898 | Switzerland | 292/170 |
| 2014230 | 8/1979 | United Kingdom | 292/169.13 |

*Primary Examiner*—Robert L. Wolfe
*Assistant Examiner*—Lloyd A. Gall
*Attorney, Agent, or Firm*—Albert O. Cota

[57] ABSTRACT

A security lock which has a housing (20) with a faceplate (22) and cover (24) forming an enclosure. A key release cylinder (30) is mounted within the cover (24) allowing manual actuation from the exterior. An electromagnetic solenoid (32) is mounted inside the housing (20) providing actuation of the lock from an external electrical circuit not part of the device. A spring loaded latchbolt (34) penetrates through the faceplate (22) and is equipped with a roller (36) for alignment. The latchbolt (34) provides the dead bolt for the lock. A door latch assembly (56) having a follower (70) inside a barrel (60) restrained by a plurality of balls (74) provides the latch. Both the latchbolt (34) and door latch (56) are retracted simultaneously by either the rotation of a key within the cylinder (30) or electrical power to the solenoid (32). A connecting linkage within attaches the elements together and a pushbutton switch (92) provides indication of the lock's position through internal electrical contacts.

6 Claims, 8 Drawing Figures

ELECTRO-MECHANICAL SECURITY LOCK

CROSS REFERENCE TO RELATED APPLICATION

This application is a continuation-in-part of application Ser. No. 763,424 filed Aug. 7, 1985 now abandoned.

TECHNICAL FIELD

This invention relates to security locks for institutions in general, and more specifically to a security system providing a combination latch and latch bolt having a dead lock, either manually key actuated or electrically operated.

BACKGROUND ART

Previously, many types of locks have been used endeavoring to provide an effective means to secure a door and prevent unauthorized access in an institution in a tamperproof manner. In most cases a deadbolt is utilized providing a sliding mechanism that provides a shear action against a strike positioned within a door jamb.

A search of the prior art did not disclose any patents that read directly on the claims of the instant invention, however, the following U.S. patents were considered related:

| U.S. Pat. No. | Inventor | Issue Date |
|---|---|---|
| 3,743,336 | Andrews | July 3, 1976 |
| 3,081,617 | McKay | March 19, 1963 |
| 2,764,440 | Marko | Sep. 25, 1956 |
| 2,449,353 | Whitmore | Sep. 14, 1948 |
| 1,817,939 | Purnell | Aug. 11, 1931 |

Andrews teaches a pivoting anti-friction rocker arm that is actuated by a spring loaded offset lever arm. Raising a recessed handle moves the lever arm to actuate a sliding bolt in a direction against a spring to disengage the latch. A pivoting rocker arm imparts rectilinear movement to a sliding bolt allowing the bolt to move past the striker.

McKay utilizes a paddle handle hinged on one end having a lock therein with an inwardly projecting tongue extending through a narrow slot. The torque engages a sliding bolt abutment and operates selectively to extend or retract the bolt upon swing movement of the paddle handle. The lock rotates a pawl into a slot within the latch flange impeding its rotary movement.

Marko employs a latch body that is provided with journal bearings in which a pindle is supported on collars of a latch lever engaged so that the lever is free to swing. The lever, further, has an L-shaped arm that reaches into a slot in a bolt guide and moves a sliding bolt against a coil spring to retract the bolt from the device.

Whitmore applies a spring loaded latch bolt that is installed within holes in a housing allowing free linear movement against the spring. A knob attached to a sleeve rotates a latch that is interlocked with the bolt, retracting the bolt when rotated, but allowing free movement to retract when engaged by an angular striker plate.

Finally, Purnell uses a lever to retract a spring loaded bolt that is wedge shaped to prevent rattling. Provided at the outer face of the latch bolt is an antifriction member comprising a roller within a recess in contact with the underside of the bolt adapted to reduce friction between the bolt and the housing.

It can, thus, be seen that prior art has utilized a sliding bolt with an angular end locked into a strike for containment of a door, however, a combination of a latch and a latch bolt with a keyed cylinder and electrical solenoid has not been introduced.

DISCLOSURE OF THE INVENTION

Tamperproof locks for high security systems such as used in penal institutions have a peculiar problem in that, not only do they require a deadbolt approach locking through shear action of a latch to a strike, but must be unlocked mechanically by the use of a key, and also remotely using electrical power. It is, therefore, a primary object of the invention to provide an apparatus that combines a tamperproof lock mechanism and an electromechanical solenoid together with a latch arrangement in one combination. Further, this invention relies upon a massive spring loaded latch assembly and a separate latch bolt independently spring loaded requiring both elements to be moved simultaneously if outside tampering is attempted. The strength of the invention is provided in the two extending latches with the relatively fragile keyed cylinder and an electromechanical solenoid linked to a unique set of hardened balls set within a barrel that is actuated mechanically through a follower. This arrangement relies upon the basic strength to be retained in contact with only the secondary linkage.

An important object of the invention further deadlocks two separate and distinct latches everytime the door closes, one being a roller containing latch bolt, and the other a tapered door latch. Since the door latch is held in place by a set of balls internally retained in shear between coacting surfaces, the latch may not be mechanically forced into retraction as more pressure is applied to the protruding element the tighter the fit becomes. While the two extending surfaces are linked together they work independently, as an example, if the latch bolt forced open it would have no effect whatsoever on the door latch as the linkage simply disengages in that mode, also the door latch is attached to a barrel that is only related to the linkage through the balls. This object clearly and independently applies a tamperproof approach to the problem of institutional locks.

Another object of the invention allows the use of a conventional keyed lock, well known in the art, that may be installed either right or left handed and keyed separately or master, as desired by the actual application.

Still another object of the invention relies upon a structure that contains no openings, slots, or interstice surfaces that objects, such as wires or thin metallic ribbons may be inserted to manipulate the internal components.

Yet another object of the invention is the optional utilization of special fastening hardware that is used to assemble the apparatus from the outside using security type heads requiring special tools for disassembly. No conventional screwdrivers, wrenchs, etc., will mate with the heads thwarting unauthorized access or tampering.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
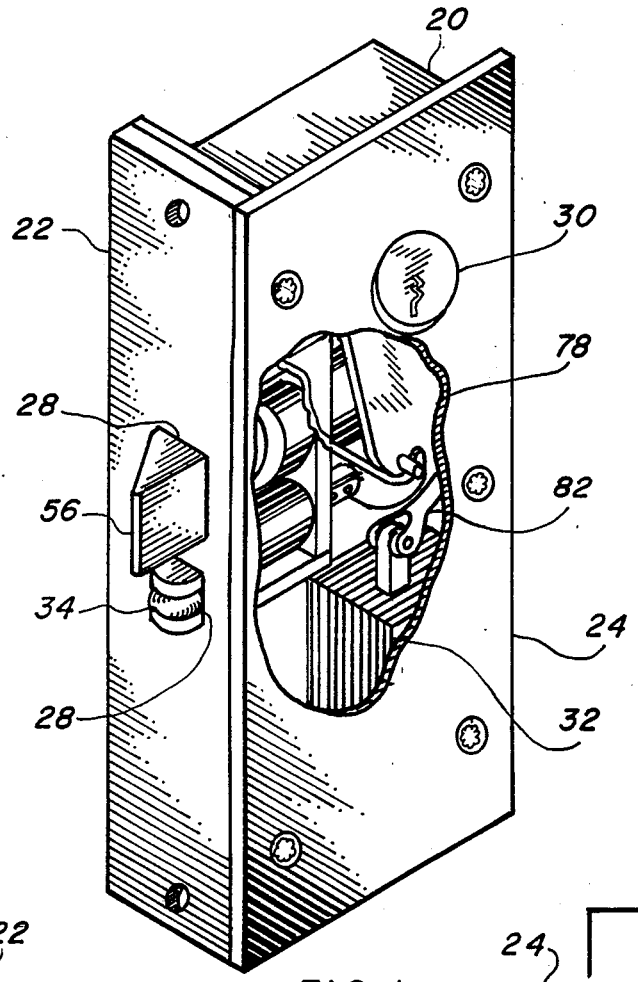
FIG. 1 is a partial isometric view of the preferred embodiment.
Figure 2:
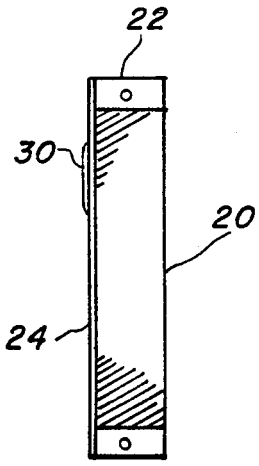
FIG. 2 is an end view of the preferred embodiment.
Figure 3:
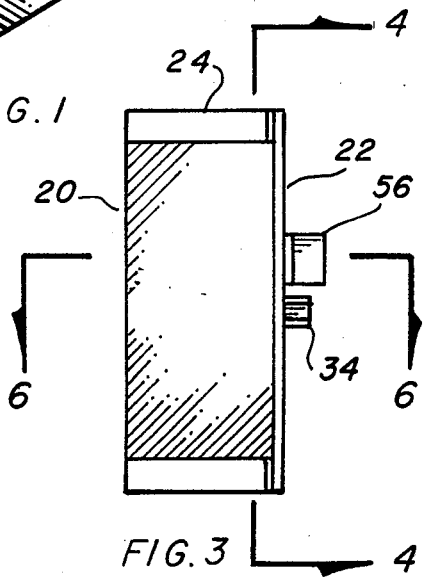
FIG. 3 is a side view of the preferred embodiment.
Figure 4:
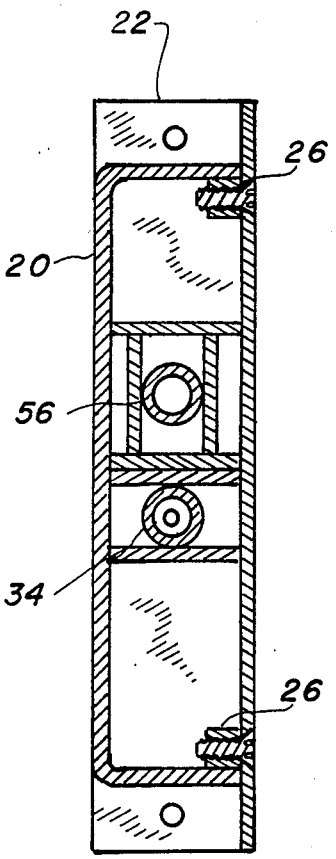
FIG. 4 is a cross-sectional view taken along lines 4—4 of FIG. 3.
Figure 5:
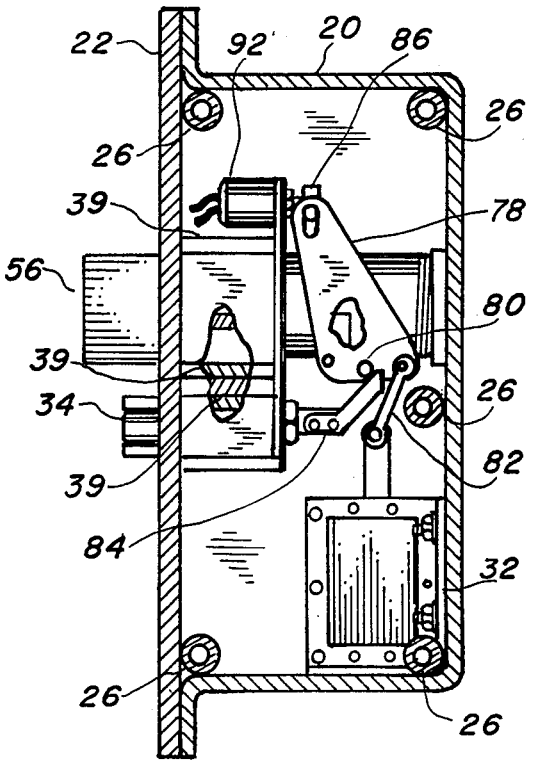
FIG. 5 is a side view of the preferred embodiment with the cover removed for clarity.
Figure 6:
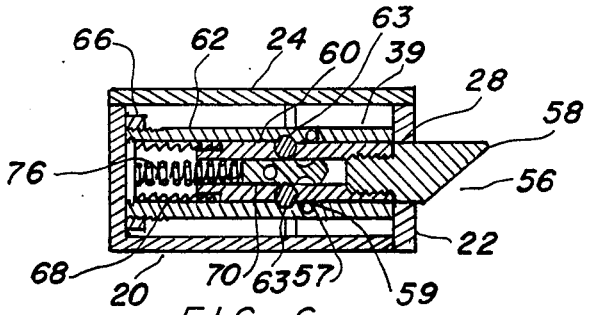
FIG. 6 is a cross-sectional view taken along lines 6—6 of FIG. 3.
Figure 7:
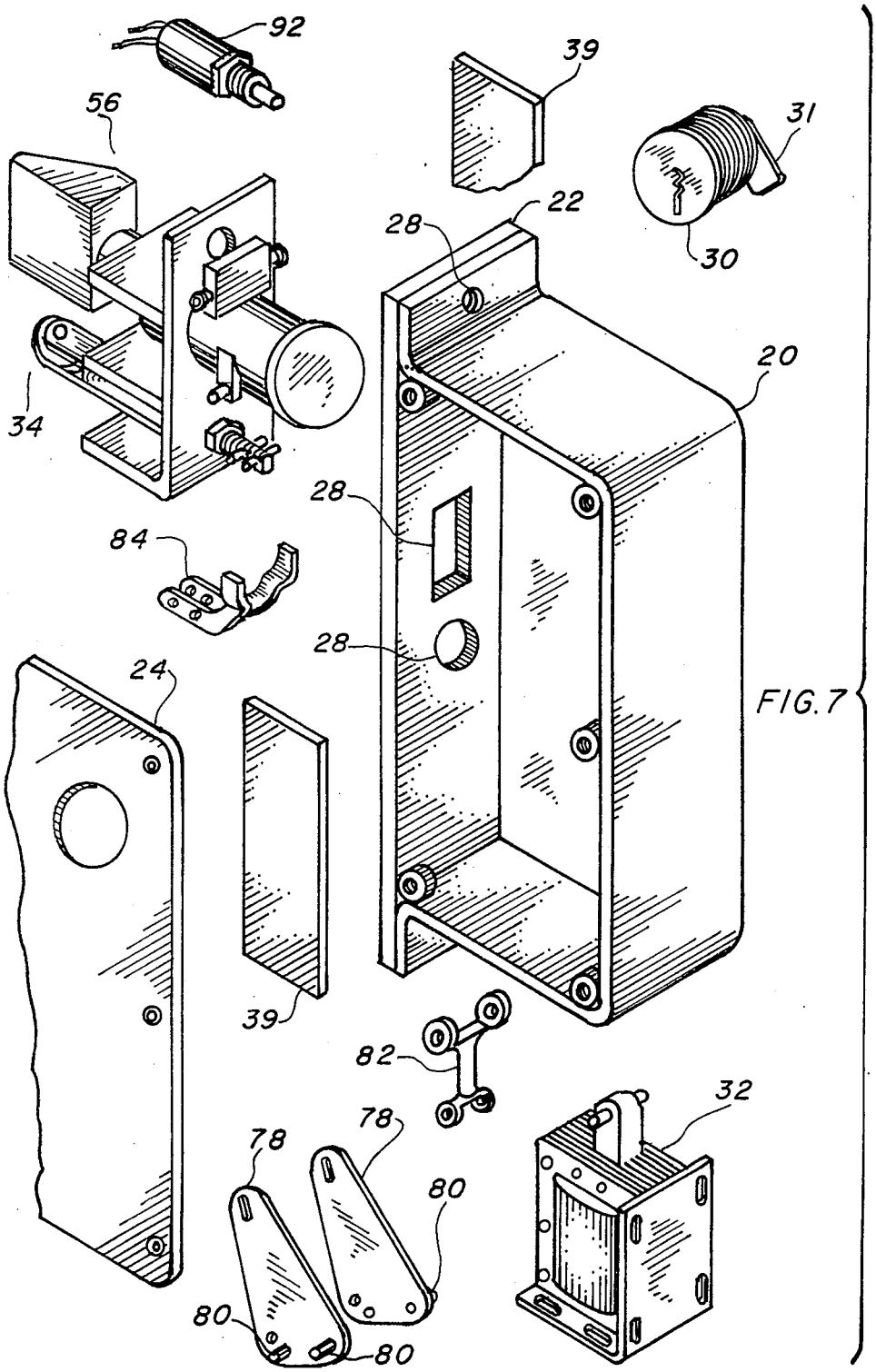
FIG. 7 is an exploded view of the preferred embodiment.
Figure 8:
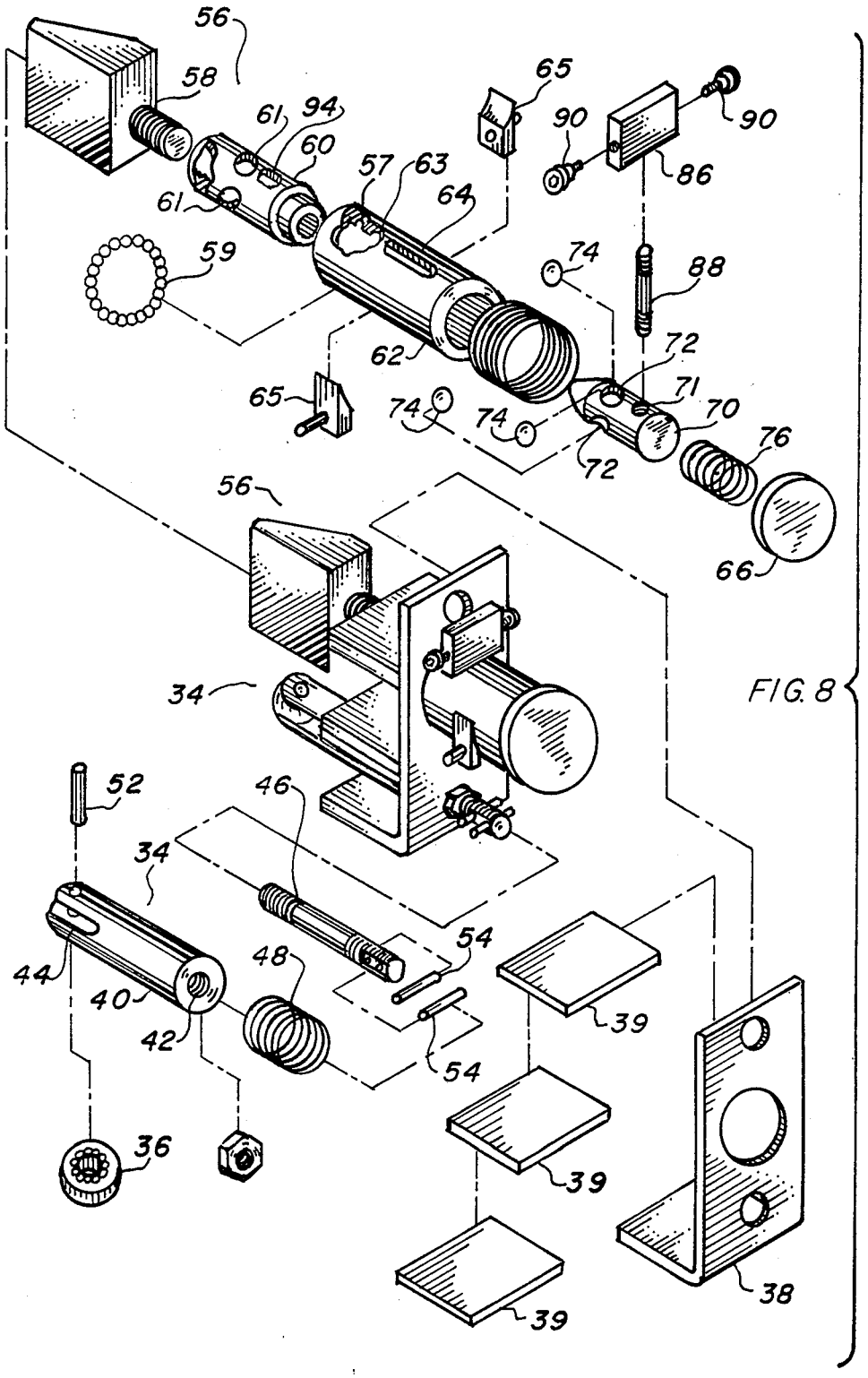
FIG. 8 is an exploded view of the latch bolt and door latch assembly removed entirely from the invention for clarity.

The best mode for carrying out the invention is presented in terms of a preferred embodiment, as shown in FIGS. 1 through 8, and is comprised of a housing 20 having a faceplate 22 and a cover 24. The housing 20 is rectangular in shape with one side open and contains a plurality of female threaded bores positioned on the inside with the threaded portion near the surface. This arrangement allows the cover 24 to be attached, as shown in FIG. 1, using countersunk special or standard hardware. The faceplate 22 side of the housing 20 contains a series of penetrations 28 through which the latching apparatus protrudes and mounting positions are accorded. The faceplate 22 is an integral part of the housing 20 in that it is permanently attached to outwardly depending flanges becoming one of the sides with attaching penetrations 28 in linear alignment with the flanges. This structure is best illustrated in FIGS. 5 and 7, and in its completed form is like an open box structure with one side having extended ends. The cover 24 is rectangular in shape and contains penetrations 28 for attachment to hold a keyed apparatus used in operation of the device. The structure, as above described, is formed preferably of a ferrous material, such as steel, and may be in the mild condition or heat treated to increase the tensile strength.

A key release cylinder 30, well known in the art, is installed through the housing cover 24 providing a key actuated mechanism for manual operation of the lock. This cylinder 30 contains a rotatable pawl 31 at the inner end that axially rotates in response to the movement of the key when inserted thereinto. This movement allows the internal mechanism to be actuated from the outside of the lock. While the position of this keyed cylinder 30 is depicted mounted within the cover 24 it may also be positioned within the housing 20 in like manner forming an opposite hand device as required by the configuration of the door on which the invention is installed.

An electromagnetic solenoid 32 is mounted on the inside of the housing 20 for electrical actuation of the invention. This solenoid 32 has a linear moving plunger slideably disposed within a continuous wire wound coil. When an electrical circuit is completed around the coil a magnetic field is created pulling the plunger into the center of the coil producing a linear thrust force used by the apparatus in the same manner as the keyed cylinder 30.

A spring loaded latchbolt 34 having an integral roller 36 extends through the faceplate 22 in a retractable manner and provides a secondary latch for the lock assembly. This latchbolt 34 is depicted in FIGS. 1, 5, and 7, and completely removed from the invention in FIG. 8. The components for this latch include an angle bracket 38 through which the element slideably extends on the inside end. This bracket 38 is installed within the housing 20 and has an opening in line with the penetration 28 in the faceplate 22 allowing the latchbolt 34 to slide linearly within these confines. It will be noted that the bracket 38 has other functions also described later in this enabling disclosure and a plurality of spacer plates 39 are attached by welding thereto to enclose moving elements.

The latchbolt 34 itself consists of a roller head 40 that is cylindrical in shape with internal threads 42 on one end, and a slot 44 in the other, having a rounded end. A stud 46, with threads on both ends, is screwed into the head 40 making a unitary structure. A compression roller spring 48 is positioned upon the stud 46 between the bracket 38 and the head 40 and acts to force the head 40 away from the bracket 38. This action spring loads the latchbolt 34, causing it to maintain its extended travel at all times, unless it is pulled back against the spring purposely. A ball bearing roller 36 having an inner and outer race with balls rotatably disposed between is located within the slot 44 in the roller head 40. A pin 52 is positioned through the head 40 holding the roller 36 in place. This roller arrangement compensates for misalignment of the lock and the strike in the door with the rounded end centering the head 40 within the hole and the roller 36 providing a reduced friction surface for penetration therewithin. A pair of roller head yoke pins 54 penetrate through the stud 46 near the end on a flattened portion allowing attachment to other functioning components to retract the head 40.

A door latch assembly 56 is located directly above the latchbolt 34 and penetrates the faceplate 22 in a retractable manner providing a latch for the invention. The latch assembly 56 is shown pictorially in an exploded view in FIG. 8 and consists of a latch 58 having a threaded round shank on one end and a beveled face on the other, allowing physical contact with the strike. A hollow latch barrel 60, having a plurality of equal spaced holes 61 in the middle, a radial groove 94, female threads on one end and a stepped shoulder on the other end, is threadably engaged to the latch 58. This barrel 60 becomes an extension of the shank of the latch 56, further forming a round body with a hollow diametrical opening inside. A hollow lock sleeve 62 having a slot 64 in the longitudinal middle area, also a bearing groove 57, and a radial internal groove 63 near one end is formed from a hollow cylinder with a bore therethrough the internal diameter of the bore slightly larger than the latch barrel 60 slideably receiving it inside. A multiple set of ball bearings 59 are positioned radially within the bearing groove 57, allowing a low coefficient of friction to be realized when the barrel 60 is located within. The sleeve 62 is retained within the angle bracket 38 and provides a rigid case in which the connected latch 58 and barrel 60 freely slide, allowing the latch 58 to extend outside of the housing faceplate 22. A pair of guide plate brackets 65 are attached on the outside middle surface of the sleeve 62 and are parallel thereunto having an outwardly extending lug at right angles to the sleeve. A cap 66 is attached to the sleeve 62 and, in turn, the cap 66 may be attached to the housing 20. This cap acts as an end to restrict the movement of the parts inside the sleeve 62. The cap 66 may be attached to the sleeve 62 by any means, such as threading, or any other convenient method known in the art.

A load spring 68 is positioned over the stepped shoulder of the latch barrel 60 and held in place therewith on one end. The other end of the spring 68 is contiguous with the cap 66 and urges the barrel 60 away from the cap 66. This arrangement maintains tension upon the latch 58 in the extended position, while still allowing linear movement retracting into the assembly 56. A conical nosed dead lock follower 70 is slideably embraced inside the latch barrel 60. The fit between the inside of the barrel 60 and the outside of the follower 70 is such that the follower may slip easily forward and aft without interference. The follower 70 contains a plurality of radial hollows 72 in the same spaced relationship as the latch barrel 60 and are positioned somewhat in the middle. The follower 70 has one end flat and the other in the shape of a blunt-nosed cone with a threaded hole 71 positioned to be in alignment with the slot 64 in the lock sleeve 62.

A plurality of round solid balls 74 are rotatably disposed within the holes 61 in the barrel 60 and are of a diameter greater than the wall thickness of the barrel 60. This provides an interference with the movement of the follower 70, unless the balls 74 are either in the radial hollows 72 of the follower 70, or in the radial internal groove 63 of the sleeve 62. This orientation of the balls and interrelation of the barrel 60 to the sleeve 62 allows the latch 58 to be firmly positioned in the locked position when the balls 74 are in the groove 63 and free to move linearly when the follower 70 retains the exposed edge of the balls 74 within the hollows 72.

A dead locking spring 76 is positioned between the cap 66 and the follower 70, urging the follower forward, captivating the balls 74 within the holes 61 in the barrel 60 and internal groove 63 of the sleeve 62. This action dead locks the door latch assembly in place until the follower 70 is slid away from the groove 63, displacing the balls 74 into the radial hollows 72, allowing the latch 58 to be retracted into the faceplate 22.

Connecting linkage means unites the solenoid 32, latchbolt 34, door latch assembly 56, and key release cylinder 30 together in order to retract the latchbolt 34 and door latch assembly 56 simultaneously when either the solenoid 32 is electrically energized, or the cylinder 30 is rotated with a key. This arrangement provides dual electrical and mechanical operation of the device. A pair of trip guide plates 78, each having a plurality of trip pins 80 outwardly depending therefrom, are pivotally mounted on the guide plate brackets 65 on the lock sleeve 62 on both sides, and are free to rotate within the confines outlined. These plates 78 become the interconnecting link between the above mentioned elements providing the associated coupling mechanism.

A solenoid connecting yoke 82, having bifurcated ends, is hingingly mated to the trip pins 80 on the plates 78 near the edge on one end and to the solenoid 32 on the other linking the pair together. This yoke 82 may be any shape having the necessary connecting characteristics, however, an "H" configuration is preferred. When the solneoid 32 is electrically energized the plunger is pulled into the coil. The yoke 82, being attached to the plates 78, rotates the plates axially transmitting the force to an associated connecting member.

A bifurcated dead lock trip arm 84 is rigidly connected to the stud 46 of the latchbolt 34 by the use of a pair of roller head yoke pins 54, or rivets, drive screws, threaded screws, etc., connecting on both sides of the stud 46. This rigid position defines a yoke with upstanding arms the same width as the parallel trip guide plates 78. This end of the trip arm 84 is contiguous with the pins 80 on the plates 78 and slideably pulls the latchbolt 34 inward against the resistance of the spring 48 when the plates 78 are rotated by the avial movement of the inside surface of the upstanding arms against the pins 54.

A follower trip plate 86 is connected to the follower 70 with a trip stud 88 that is inserted into the threaded hole 71 forming a "T" like assembly that protrudes upwardly through the slot 64 in the lock sleeve 62. This plate 86 slideably moves in a linear motion fore and aft within the confines of the slot 64. A pair of shoulder screws 90, or the like, are connected into the sides of the plate 86 and attach in a rotatable manner with the guide plates 78. This connection completes the interconnection of the latchbolt 34 with the door latch assembly 56 and its accompanying solenoid 32. The trip plate 86 creates a surface upon which the pawl 31 of the key release cylinder 30 may rest. When the key of the cylinder 30 is rotated, the pawl 31 contiguously urges the door latch 56 in a linear direction and simultaneously the latch bolt 34 retracting both of them from the faceplate 22. This retraction is duplicated when the solenoid 32 is energized, either function opening the security lock.

A pushbutton switch 92 is threadably fixed to the bracket 38 of the latchbolt assembly 34 with the actuating button in contact with the follower trip plate 86. Movement of the trip plate 86 causes an electrical contact to be made, or broken, within the switch 92 itself, indicating the position of the lock, either opened or closed. This switch may have any combination of contacts, either normally open or normally closed, allowing signal communication with a monitoring system, or an interlock series in combination with a plurality of security locks. Special fastening hardware requiring distinct tools for assembly, such as shown in FIG. 1, may be utilized for fastening components together where the heads are exposed to the outside surface or the fasteners may be the conventional type well known in the art both within the scope of this invention.

In operation, a key is placed in the key release cylinder 30 and the pawl 31 is rotated forcing the trip plate 86 to move away from the faceplate 22. Electrically energizing the solenoid 32 accomplishes the same function as the trip plate 86 is attached at the sides to a pair of guide plates through a yoke 82. In either event the trip plate 86 is attached to a conical nosed deadlock follower 70, which is pulled away from the faceplate until the balls 74 that are held tight into a radial groove 63 of a sleeve 62 are aligned into radial hollows 72 in the follower 70. As the rearward movement continues, the latch barrel 60 is then pulled by the balls 74 in contact with the holes 61 against spring pressure retracting the latch 58 inside the housing 20. Simultaneously, while the latch 58 is being retracted, the latchbolt 34 is also retracted into the housing 20. This is accomplished by the radial movement of the guide plates 78 which rotate pins 80 downward against a radially shaped surface of the trip arm 84. The downward movement changes the orientation of the upwardly depending arms on the trip arm 84 in respect to the pins 80 forcing the latchbolt 34 inward releasing the lock completely.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. A security lock for architectural security systems comprising:

(a) a housing, having a faceplate on one narrow end and a cover on one wide side, formed into a rectangular shape defining a box-like structure;

(b) a key release cylinder, having a rotatable pawl, installed through said housing cover providing a key actuated mechanism for manual operation of said lock;

(c) an electromagnetic solenoid mounted inside said housing having a linear moving plunger providing mechanical movement when electrically energized therewith;

(d) a spring loaded latchbolt having an integral roller penetrates through said faceplate in a retractable manner providing a secondary latch for said lock;

(e) a door latch assembly having a conical nosed dead lock follower within a latch barrel restrained by a plurality of round solid balls penetrates said faceplate in a retractable manner providing a latch for said lock; and, (f) connecting linkage means unites said solenoid, latchbolt, door latch and cylinder together in such a manner as to retract said latchbolt and door latch simultaneously when said solenoid is electrically energized, and also when said cylinder is rotated by said key providing a dual electrical and mechanical operation.

2. The security lock as recited in claim 1 further comprising: a plurality of female threaded bosses disposed on the inside of said housing near the surface providing an assembly interface for attaching said cover upon the housing, and said housing, and said cover having penetrations therethrough to receive said cylinder, latchbolt and door latch protecting the security of the system.

3. The security lock as recited in claim 1 wherein said latchbolt further comprises:

(a) an angle bracket having a plurality of spacers attached thereto in a box-like manner;

(b) a stud slidingly disposed through said bracket at right angles, having threaded portions distending on each side acting as a connecting rod;

(c) a roller head with a first end threadably attached onto one end of said stud and a slot in the other end;

(d) a compression roller spring expandingly positioned between said bracket and roller head urging the head away from the bracket in a compressively loaded manner; and, (e) a ball bearing roller structurally located within the slot in the roller head to compensate for misalignment when penetrating beyond said housing and faceplate.

4. The security lock as recited in claim 1 wherein said door latch assembly further comprises:

(a) a latch having a threaded shank on one end and a beveled face on the other;

(b) a hollow latch barrel having a plurality of equal spaced holes in the middle, a female groove, female threads on one end and a stepped shoulder on the other, said latch threadably engaging said barrel forming a movable round body;

(c) a hollow lock sleeve having a slot in the middle, a bearing groove, an internal groove and a bore slightly larger in diameter than said latch barrel slideably receiving said latch barrel on the inside thereof;

(d) a plurality of ball bearings are rotatably positioned within said sleeve bearing groove providing a low coefficient of friction between said sleeve and said barrel;

(e) a cap attached to the end of the lock barrel opposite the latch providing a sealing surface thereupon;

(f) a load spring positioned over the stepped shoulder of said latch barrel and held in place therewith on one end and contiguous with said cap on the other, urging said latch barrel away from the cap providing the spring loading for the latch;

(g) said conical nosed dead lock follower having a plurality of radial hollows in the same space relationship as said latch barrel and a diameter slightly smaller than the inside of said hollow latch barrel and slideably received therein;

(h) said plurality of round solid balls disposed within said latch barrel holes and said radial hollows of said follower providing the restrainment for holding the latch in a locked position; and, (i) a dead locking spring positioned between said cap and said follower urging the follower forward captivating said balls within said holes in the barrel and internal groove in the sleeve deadlocking the door latch assembly in place until said follower is slid away from said internal groove displacing the balls into the hollows allowing the latch to be retracted into said housing.

5. The security lock as recited in claim 1 wherein said connecting linkage further comprises:

(a) a pair of trip guide plates each having a plurality of trip pins extending therefrom pivotally mounted on both sides of said door latch assembly providing an associated coupling mechanism;

(b) a solenoid connecting yoke hingingly mated to each guide plate near the edge on one end and to said solenoid on the other, transmitting movement therebetween;

(c) a bifurcated dead lock trip arm rigidly connected to said latchbolt on one end and slideably contiguous with said trip pins on said guide plates on the other retracting said latchbolt into said housing when the guide plates are rotated thereupon; and, (d) a follower trip plate connecting said door latch assembly to said trip guide plates to create a surface upon which said cylinder pawl upon rotation contiguously slides said door latch in a linear direction away from said face plate and simultaneously said latchbolt providing retraction of both into said housing when the keyed cylinder is rotated, also retraction is duplicated when said electromagnetic solenoid is energized opening said security lock.

6. The security lock as recited in claim 1 further comprising: a pushbutton switch in contact with said trip plate providing an electrical contact indicating the position of the lock, either opened or closed, for remotely monitoring and interlocking said security lock.

* * * * *